343-700 MS AU 251 EX
7/7/87 OR 4,679,051

United States Patent [19]
Yabu et al.

[11] Patent Number: 4,679,051
[45] Date of Patent: Jul. 7, 1987

[54] MICROWAVE PLANE ANTENNA

[75] Inventors: Yasuo Yabu, Hirakata; Toshio Abiko, Ibaragi; Masayuki Matsuo, Kobe, all of Japan

[73] Assignee: Matsushita Electric Works, Ltd., Osaka, Japan

[21] Appl. No.: 790,241

[22] Filed: Oct. 22, 1985

[30] Foreign Application Priority Data

Nov. 1, 1984 [JP] Japan ..... 59-230875
Dec. 19, 1984 [JP] Japan ..... 59-269299

[51] Int. Cl.[4] ..... H01Q 1/00
[52] U.S. Cl. ..... 343/700 MS; 343/758; 343/806
[58] Field of Search ..... 343/700 MS, 757, 758, 343/806, 853, 879, 880

[56] References Cited

U.S. PATENT DOCUMENTS 4,203,118 5/1980 Alford ..... 343/806
4,475,107 10/1984 Makimoto et al. ..... 343/700 MS

FOREIGN PATENT DOCUMENTS 55-53905 4/1980 Japan ..... 343/700 MS
58-125901 7/1983 Japan ..... 343/700 MS

*Primary Examiner*—Robert E. Wise
*Attorney, Agent, or Firm*—Burns, Doane, Swecker & Mathis

[57] ABSTRACT

A microwave plane antenna in which antenna bodies carrying thereon respectively at least a pair of microstrip lines are mounted to a supporting frame through means for movably positioning the antenna bodies along a plane including an axis perpendicular to the plane of the antenna body and another axis in the width direction of each pair of the microstrip lines, whereby the main beam direction of the plane antenna is made settable optionally in three-dimensional zone to be in the optimum direction with respect to a geostationary broadcasting satellite for remarkably improving the reception gain.

7 Claims, 7 Drawing Figures

MICROWAVE PLANE ANTENNA

TECHNICAL BACKGROUND OF THE INVENTION

This invention relates to a microwave plane antenna for receiving circularly polarized waves.

The microwave plane antenna of the type referred to is effective to receive circularly polarized waves which are transmitted as carried on SHF band, in particular, 12 GHz band, from a geostationary broadcasting satellite launched into cosmic space 36,000 Km high from the earth.

DISCLOSURE OF PRIOR ART

Antennas generally used by listeners for receiving such circularly polarized waves sent from the geostationary broadcasting satellite are parabolic antennas erected on the roof or the like position of house buildings. However, the parabolic antenna has been involving such problems that it is susceptible to strong wind to easily fall due to its bulky structure so that an additional means for stably supporting the antenna will be necessary, and the supporting means further requires such troublesome work as a fixing to the antenna of reinforcing pole members forming a major part of the supporting means, which work may happen to result even in a higher cost than that of the antenna itself.

In attempt to eliminate these problems of the parabolic antenna, there has been suggested in Japanese Patent Appln. Laid-Open Publication No. 57-99803 (corresponding to U.S. Pat. No. 4,475,107 or to German Offenlegungsschrift No. 3149200) a plane antenna, which is flattened in the entire configuration and comprises a plurality of cranked microstrip lines arranged in pairs on the upper surface of an antenna body of an insulating substrate of a Teflon glass fiber, polyethylene or the like, and an earthing conductor provided over the entire lower surface of the antenna body. The pairs of the microstrip lines are connected respectively at one end with each of branched strip line conductors of a power supply circuit in a tournament connection, while a termination resistor is connected at the other end ofthe respective pairs, so that a travelling wave current can be supplied parallelly to them in the same amplitide and phase.

In this case, cranked portions included in each microstrip line in each pair are positioned to be staggered with respect to such portions in adjacent one of the lines so that spatial phases of the lines in each pair will be mutually different and the grating lobe of the radiation beam will be restrained to sharpen the directivity of the entire plane antenna. Supposing that "x" axis is the one vertical to a plane including the antenna body, "y" axis is the one in the width direction of the paired microstrip lines, and "z" axis is the one in the longitudinal direction of the respective microstrip lines, it is made possible to properly set the main beam direction of the plane antenna for obtaining the maximum reception gain, by varying the dimensions of the cranked portions in the respective microstrip lines to position their directivity in x-y plane to be in the optimum direction.

Such arrangement as above has effectively simplified the structure of the antenna for the circularly polarized waves to render it inexpensive and even mountable directly on a wall surface of house buildings, eliminating thus the necessity of any additional supporting means, to remarkably reduce required mounting cost. In this plane antenna, however, the main beam direction is made variable in the x-z plane to some extent but still remains not adjustable in the x-y plane, that is, the main beam direction cannot be optionally set in all planes, that is, in three-dimensional zone. For this reason, the foregoing antenna still has been defective in that the reception gain has to be lowered when the antenna mounting surface of house buildings is tilted from an intended posture for obtaining the maximum reception gain in the plane corresponding to the x-y plane of the antenna, or when it is necessary to tilt the antenna from the maximum reception gain posture to minimize any influence of wind or snow.

TECHNICAL FIELD OF THE INVENTION

A primary object of the present invention is, therefore, to provide a microwave plane antenna of which main beam is settable not only in the x-z plane but also in the x-y plane, so as to be able to optionally set incident angle of the microwaves transmitted from the geostationary broadcasting satellite in three-dimensional zone and thus to improve the reception gain.

According to the present invention, this object can be attained by providing a microwave plane antenna which comprises a plurality of pairs of cranked microstrip lines each having cranked portions staggered in each of the pairs, and a power supply circuit including branched lines in tournament connection and respectively connected to one end of each pair of the microstrip lines, which further comprises a plurality of antenna bodies of a dielectric material respectively carrying at least one of the pairs of the microstrip lines, and an antenna body supporting frame, the antenna bodies being mounted to the frame through means for movably positioning the antenna bodies along a plane including an axis perpendicular to the plane of each antenna body and another axis in the width direction of each pair of the microstrip lines.

Other objects and advantages of the present invention shall be made clear in the following description of the invention detailed with reference to preferred embodiments shown in accompanying drawings.

Figure 1:
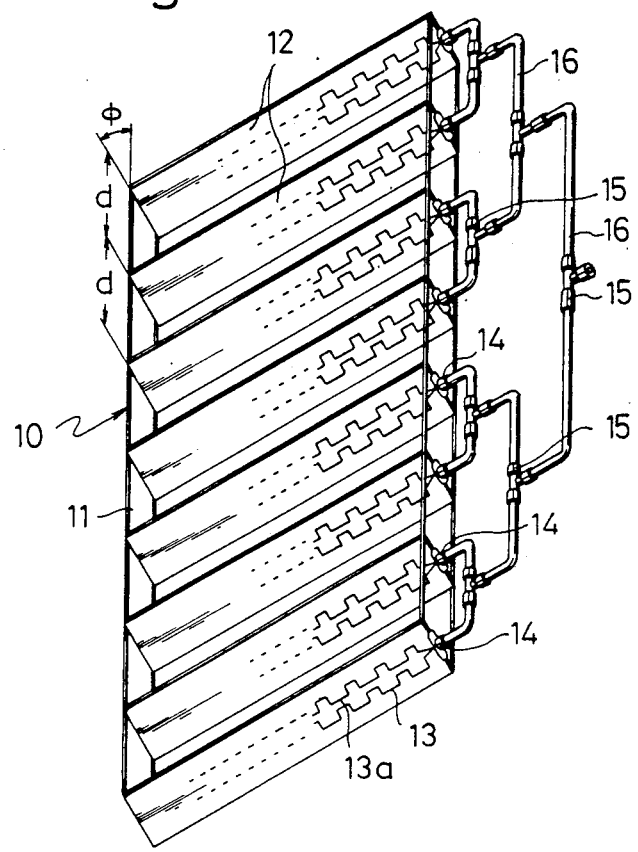
FIG. 1 is a schematic perspective view of a plane antenna as seen from one longitudinal end side for showing the entire arrangement in an embodiment according to the present invention.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 2:
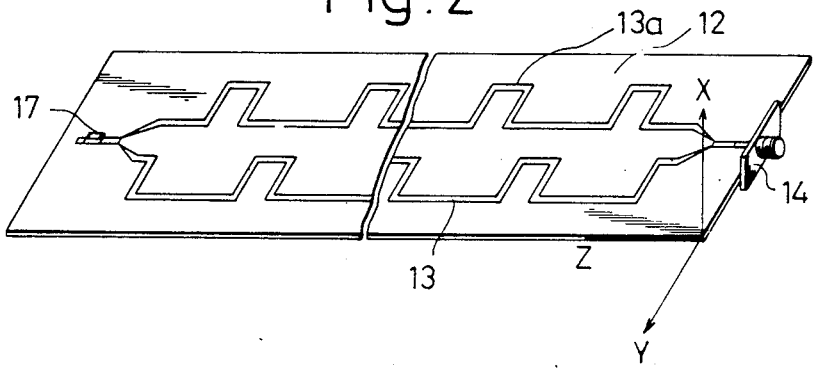
FIG. 2 is a perspective view as magnified for showing details of one of antenna bodies used in the plane antenna of FIG. 1.

According to the present invention, a plurality of antenna bodies each having at least a pair of microstrip lines are arranged in stages as spaced by a distance corresponding to an integer multiple of a spatial wavelength $\lambda_o$ of a microwave transmitted from a geostationary broadcasting satellite. Referring to FIGS. 1 and 2, a plane antenna 10 includes a supporting frame 11 on which a plurality of antenna bodies 12 are mounted respectively at an angle $\phi$ with respect to the plane of the frame as fixed directly thereto or for rotation through a proper rotary linkage (not shown here) at their both longitudinal ends. The antenna bodies 12 are mutually spaced by a distance "d" set between their opposing surfaces, and this distance "d" is set to be "n" times ("n" being a natural number) as large as the spatial wavelength $\lambda_o$ of the transmission wave from the satellite, but is made properly variable by moving the antenna bodies 12 along the supporting frame 11.

The antenna bodies 12 comprise respectively a dielectric substrate onto the rear face of which an earthing conductor is fixed and on the front face of which 2 n microstrip lines 13 and 13*a* ("n" being a natural number, while the drawing shows two of them as an example) are formed by means of, for example, an etching process. The formation and arrangement of the microstrip lines 13 and 13*a* or those specifically in relation to the setting of the main beam direction in the x-z plane may be substantially the same as those described in the foregoing Japanese Laid-Open Publication. That is, the microstrip lines lying parallel in each pair are cranked at mutually staggered positions, so as to provide mutually different spatial phases and an interference action between the paired microstrip lines, for restraining the grating lobe of the radiation beam and sharpening the antenna directivity.

On one side of the supporting frame 11, a coaxial connector 14 is connected to one end of the paired microstrip lines 13 and 13*a* in each of the antenna bodies 12, and branched coaxial cables 16 which are connected through branching connectors 15 for forming a power supply circuit of tournament connection are connected respectively to each of pairs of adjacent coaxial connectors 14, while a termination resistor 17 is connected to the other end of the each pair of the microstrip lines 13 and 13*a*, so that a travelling wave current can be supplied to the respective paired microstrip lines 13 and 13*a* through the supply circuit of the coaxial cables 16 parallelly in the same amplitude and phase.

In such arrangement as above, the distance "d" between the opposing faces of the respective antenna bodies 12 so set as to be an integer multiple of the spatial wavelength $\lambda_o$ of the reception (or transmission) microwave causes the mutual equiphase surface of the respective pairs of the microstrip lines in the antenna bodies 12 to be tilted responsive to the distance "d" so that the main beam direction can be tilted at a certain angle relative to the "x" axis in the x-y plane, whereby, in combination with the known arrangement for setting the main beam direction in the x-z plane, the main beam can be optimumly set within the three-dimensional zone including the both x-z and x-y planes and a so-called side looking function can be freely provided to the antenna.

In the illustrate embodiment, a phase shifter (while not shown) may be connected to the respective pairs of the microstrip lines 13 and 13*a* in each of the antenna bodies 12 so that the phase of the travelling wave current to the respective microstrip lines 13 and 13*a* can be finely adjusted, whereby it is made possible to have the mutual equiphase surface of the respective paired microstrip lines 13 and 13*a* tilted to render the main beam direction adjustable in the x-y plane. When the angle $\phi$ of the antenna bodies 12 with respect to the supporting frame 11 is relatively small, it is desirable to increase the width of the antenna body 12 as well as the number of pairs of the microstrip lines 13 and 13*a*.

Figure 3:
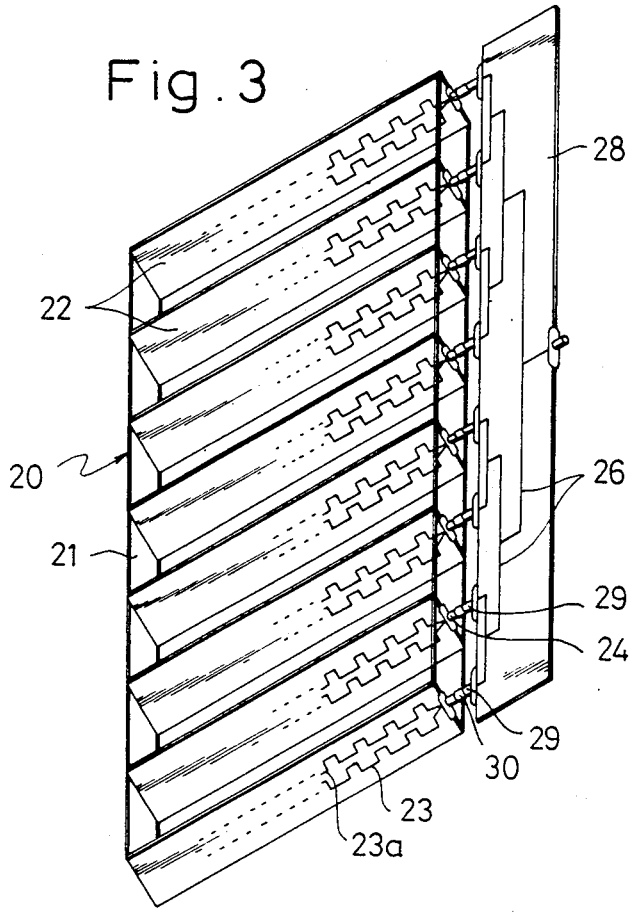
FIG. 3 is a schematic perspective view of a plane antenna as seen from one longitudinal end side for showing the entire arrangement in another embodiment according to the present invention.
Figure 4:
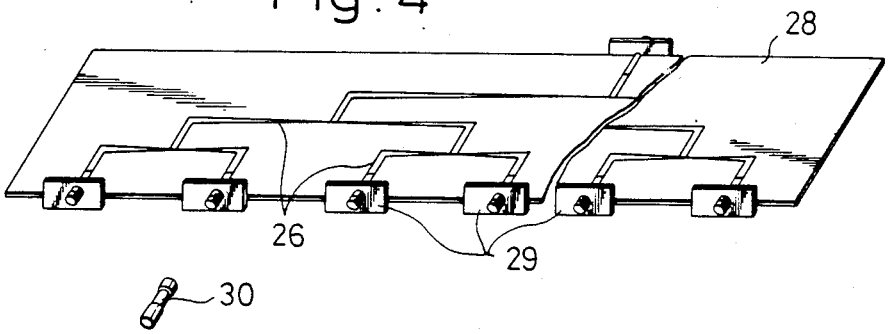
FIG. 4 is a perspective view as magnified of a power supply circuit used in the plane antenna of FIG. 3.

In addition, the power supply circuit comprising the branching connectors 15 and coaxial cables 16 in the foregoing embodiment may be replaced by such a printed-circuit board 28 as shown in FIGS. 3 and 4. In that case, the printed-circuit board 28 is formed to have branched strip lines 26 in the tournament connection and connected respectively at their termination end to an associated coaxial connector 24 of each antenna body 22 through coaxial connectors 29 and connection fittings 30, other arrangement and operation of this embodiment of FIGS. 3 and 4 are substantially the same as those of the embodiment of FIGS. 1 and 2, and constituent members corresponding to those in the latter are denoted by the same reference numerals but added by 10.

Figure 5:
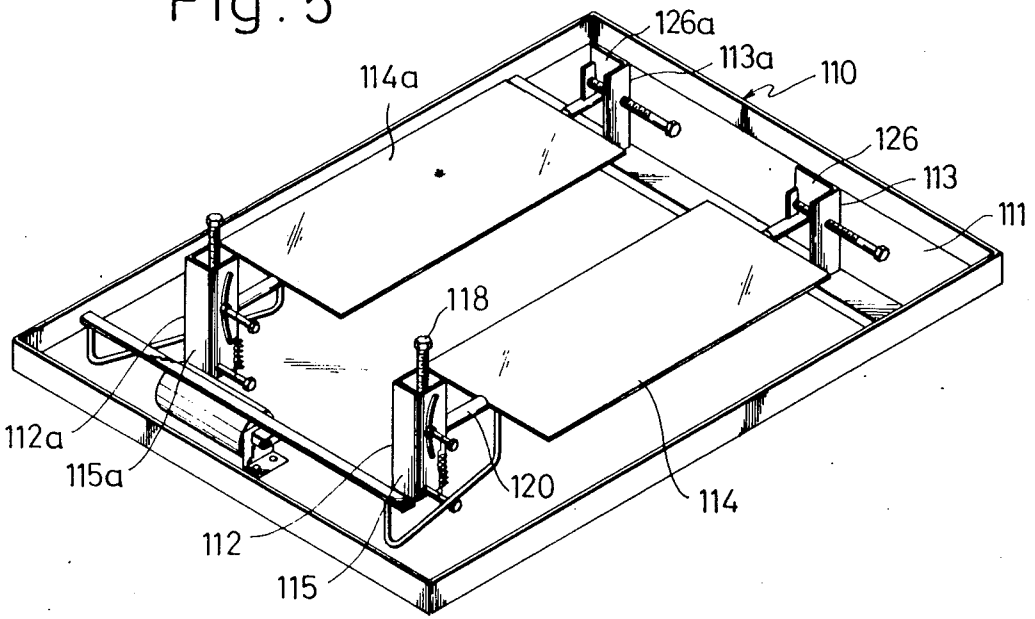
FIG. 5 is a perspective view showing the entire arrangement of yet another embodiment of the plane antenna according to the present invention.
Figure 7:
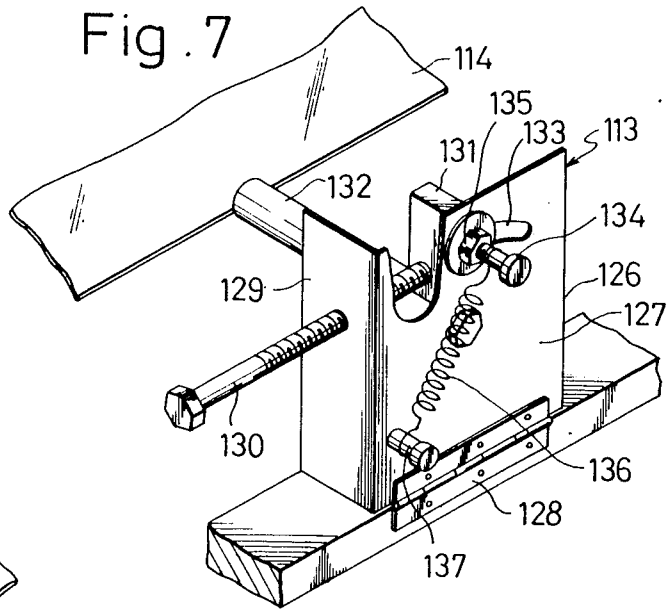
FIG. 7 is a perspective view as magnified of a second positioning means in the plane antenna of FIG. 5.
Figure 6:
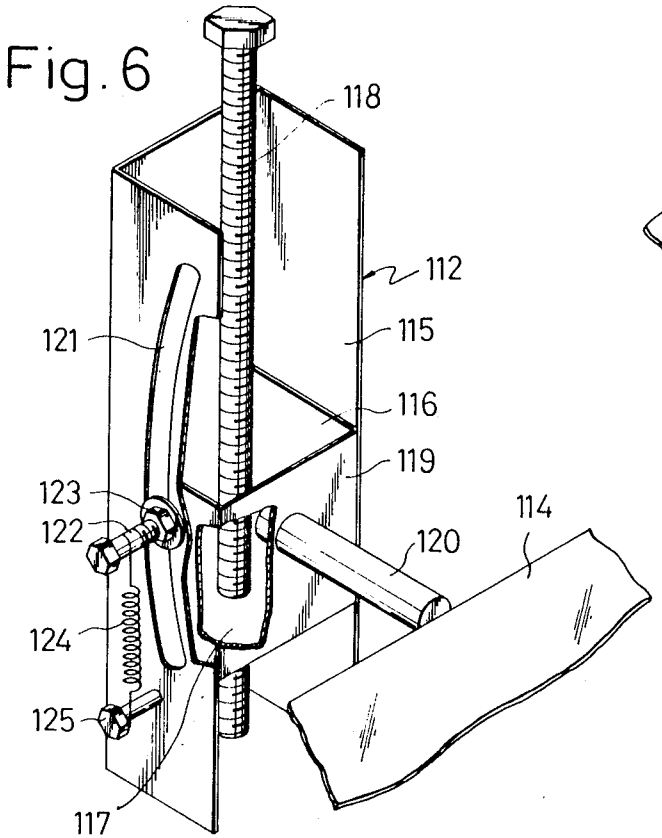
FIG. 6 is a perspective view as magnified of a first positioning means in the plane antenna of FIG. 5.

According to another feature of the present invention, a plurality of antenna bodies respectively including a plurality of pairs of microstrip lines and their power supply circuit are mounted on a supporting frame so that the antenna bodies will be mechanically shiftable in the three-dimensional mode including the x-z and x-y planes. Referring to FIGS. 5 to 7, a plane antenna 110 includes a supporting frame 111 on which antenna bodies 114 and 114*a* are mounted respectively as held at their longitudinal ends by a pair of first and second positioning means 112 and 113 or 112*a* and 113*a*. While not shown, the antenna bodies 114 and 114*a* themselves are formed to be the same as in the foregoing Japanese Patent Laid-Open Publication so that a plurality of pairs of the microstrip lines are formed on each dielectric substrate to extend preferably in the longitudinal direction of the body, between the first and second positioning means, and the power supply circuit is connected to the pairs of the microstrip lines on each substrate at their one longitudinal end while the termination resistor is connected to each pair of the lines at the other end.

The first positioning means 112 and 112*a* comprise respectively an elongated guide 115 or 115*a* U-shaped in section and erected on the supporting frame 111. As the means 112 and 112*a* are substantially of the same structure, only one of them shall be explained here. As seen in FIG. 6, a box-shaped slider 116 is inserted in the guide 115 for vertical sliding therein, that is, along the "x" axis perpendicular to the plane of the antenna body 114. The slider 116 is opened at least at its top side and has a threaded hole in the center of bottom plate 117 for meshing with screw threads on a height adjusting bolt 118 passed through the threaded hole in the bottom plate 117 and abutting at the lower end against the upper surface of the supporting frame 111. A side wall 119 of the slider 116 exposed at vertical opening of the guide 115 carries as fixed thereto a laterally extended rod 120 which is coupled to a longitudinal end of the antenna body 114 on its power-supply circuit side. The guide 115 is provided in its one side wall with a guiding slit 121, a fixing screw 122 having a fixing nut 123 thereon is passed through the guiding slit 121 as well as one side wall of the slider 116 facing the slit 121, and a tension spring 124 is engaged at its one end to the screw 122 and at the other end to an engaging projection 125 extruded from the guide 115 at the lower part of the guiding slit 121. With such arrangement, an axial rotation in one direction of the adjusting bolt 118 on the supporting frame 111 causes the slider 116 to shift upwards or downward together with the power-supply-circuit side end of the antenna body 114 and, when the fixing nut 123 is tightened at a desired position along the slit 121, the particular end of the antenna body 114 can be adjustably fixed at a desired position. That is, the antenna body 114 is mechanically shiftable along the x-z plane defined by the "x" axis vertical to the plane of the antenna body and the "z" axis in the longitudinal direction of the microstrip lines.

The second positioning means 113 and **113*a* include respectively an adjustment frame 126 or 126*a* which is L-shaped in cross-section and erected on the supporting frame 111. These means 113 and 113*a* are substantially of the same arrangement and only one of them shall be explained here. As seen in FIG. 7, the adjustment frame 126 is secured to the supporting frame 111 at the lower end edge of longer side leg 127 of the U-shape through a hinge 128 so that the upward and downward shifts at the power-supply-circuit side end of the antenna body 114 by means of the first positioning means 112 will cause the second positioning means 113 to rock in the x-z plane, i.e., in a vertical plane normal to a plane of the longer side leg 127. A threaded adjusting bolt 130 is passed through a threaded hole in a shorter side leg 129 of the L-shaped adjustment frame 126 to extend horizontally in the width direction of the antenna body 114, a rocking member 131 is secured at the lower end to an outer end part of a coupling rod 132 which is coupled at the other inner end to the termination-resistor side end of the antenna body 114 and held axially rotatably by the longer side leg 127 of the frame 126, and the rocking member 131 is positioned to abut extended end of the bolt 130. An arcuate guiding slit 133 is formed in the longer side leg 127 of the adjustment frame 126, a fixing screw 134 having thereon a fixing nut 135 is projected out of the movable member 131 slidable along the longer side leg 127 of the frame 126 and passed through the slit 133, and a tension spring 136 is engaged at one end to the fixing screw 134 and at the other end to an engaging projection 137 extruded from the longer side leg 127 at its lower corner part. With this arrangement, therefore, an axial rotation of the adjustment bolt 130 in either direction about its axis will cause the rocking member 131 to rotate with the rod 132 about its axis, and the antenna body 114 is thereby rotated about the rod 132. Therefore, when the fixing nut 135 caused to slide along the slit 133 with the above rotation is tightened at a desired position, the antenna body 114 can be fixed at a desired angular position. In other words, the antenna body 114** is thus made mechanically shiftable in the x-y plane defined by the "x" axis vertical to the plane of the antenna body and the "y" axis in the width direction of the microstrip lines.

In the embodiment of FIGS. 5 to 7, therefore, the adjusting shifts of the respective antenna bodies in the x-z and x-y planes can be mechanically achieved by the first and second positioning means 112, **112*a* and 113, 113*a*, so that the antenna bodies parallelly arranged on the supporting frame 111** can be adjustably shifted in the three-dimensional zone respectively independently, any fluctuation in the directivity between the respective antenna bodies can be thereby properly eliminated, and the microwave receiving surfaces of the respective antenna bodies can be properly disposed for providing the maxium reception gain and thus improving the total gain of the entire antenna bodies.

The present invention may be modified in various manners. For example, two antenna bodies have been disclosed to be employed in the embodiment of FIGS. 5 to 7, but they can be increased in number as required.

What is claimed as our invention is:

1. A microwave plane antenna comprising antenna bodies respectively of a dielectric material and carrying thereon at least a pair of substantially parallel microstrip lines cranked at mutually staggered positions, a frame for supporting two or more of said antenna bodies, a power supply circuit branched and connected to one end of each of said pairs of said microstrip lines for their tournament connection, and means for adjustably positioning the antenna bodies relative to said supporting frame by shifting the respective antenna bodies in a plane including a first axis vertical to a plane of the antenna body and a second axis in the width direction of the pair of the microstrip lines.

2. A plane antenna according to claim 1, wherein said positioning means comprises said supporting frame which is arranged for supporting said antenna bodies in a plurality of stages as mutually spaced by a distance corresponding to an integer multiple of a spatial wavelength of a transmission microwave.

3. A plane antenna according to claim 2, wherein said antenna bodies are mounted on said supporting frame to be rotatable with respect to said transmission microwave.

4. A plane antenna according to claim 2, wherein each of said antenna bodies carries 2 n (n being a natural number) of said microstrip lines.

5. A plane antenna according to claim 2, which further comprises a phase shifter connected to each of said pairs of microstrip lines.

6. A plane antenna according to claim 1, wherein said positioning means comprises first and second positioning means erected on said supporting frame, said first positioning means supporting respective said antenna bodies at their one longitudinal end for shifting said end vertically with respect to the frame on which the means is erected, and said second positioning means supporting respective said antenna bodies at their other end for rotating the body about its longitudinal axis.

7. A plane antenna according to claim 6, wherein said shifting of said antenna body by said first positioning means is made in a plane including said first axis and a third axis in the longitudinal direction of said microstrip lines, and said rotation of the antenna body by said second positioning means is made in said plane including said first and second axes.

* * * * *